US008444510B2

(12) United States Patent
Olsson et al.

(10) Patent No.: US 8,444,510 B2
(45) Date of Patent: May 21, 2013

(54) METHOD FOR DESIGNING A GOLF CLUB

(75) Inventors: Breit Olsson, Sollentuna (SE); Tony Björkman, Östhammar (SE)

(73) Assignee: Isaren AB, Sollentuna (SE)

( * ) Notice: Subject to any disclaimer, the term of this patent is extended or adjusted under 35 U.S.C. 154(b) by 201 days.

(21) Appl. No.: 12/994,362

(22) PCT Filed: Jun. 12, 2009

(86) PCT No.: PCT/SE2009/000299

§ 371 (c)(1),
(2), (4) Date: Nov. 23, 2010

(87) PCT Pub. No.: WO2009/151371

PCT Pub. Date: Dec. 17, 2009

(65) Prior Publication Data

US 2011/0077095 A1 Mar. 31, 2011

(30) Foreign Application Priority Data

Jun. 13, 2008 (SE) ..... 0801390

(51) Int. Cl.
*A63B 53/00* (2006.01)

(52) U.S. Cl.
USPC ..... 473/409; 473/289

(58) Field of Classification Search
USPC ..... 473/287, 289, 409
See application file for complete search history.

(56) References Cited

U.S. PATENT DOCUMENTS

| | | | | |
|---|---|---|---|---|
| 4,128,242 | A * | 12/1978 | Elkins, Jr. | 473/291 |
| 4,157,181 | A * | 6/1979 | Cecka | 473/319 |
| 4,415,156 | A * | 11/1983 | Jorgensen | 473/291 |
| 4,563,007 | A * | 1/1986 | Bayliss et al. | 473/409 |
| 5,294,118 | A * | 3/1994 | Iwanaga | 473/316 |
| 5,351,953 | A * | 10/1994 | Mase | 473/289 |
| 5,421,573 | A * | 6/1995 | Kawamatsu | 473/319 |
| 5,634,861 | A * | 6/1997 | Yamamoto et al. | 473/319 |
| 5,769,733 | A | 6/1998 | Williams et al. | |
| 5,971,865 | A * | 10/1999 | Shenoha et al. | 473/316 |
| 6,929,562 | B2 * | 8/2005 | Kumamoto | 473/319 |
| 7,147,572 | B2 * | 12/2006 | Kohno | 473/314 |
| 2002/0107089 | A1 * | 8/2002 | Yamada | 473/319 |
| 2003/0073507 | A1 | 4/2003 | Shiraishi | |
| 2010/0255925 | A1 | 10/2010 | Olsson et al. | |

FOREIGN PATENT DOCUMENTS

WO 0062872 10/2000

* cited by examiner

*Primary Examiner* — Stephen L. Blau
(74) *Attorney, Agent, or Firm* — Capitol City TechLaw

(57) ABSTRACT

The present invention relates to a method for determining club parameters for at least one golf club, belonging to a set of golf clubs for a specific golfer, having arbitrary club length $L_{k,n}$. The method comprises: selecting club length of a first reference golf club and a second reference club; varying at least one club parameter belong to the group: club weight, club head weight, CG position and weight distribution of the first reference golf club and the second reference golf club; selecting a club parameter value for each selected club parameter. At least one torsional moment PCF, ICF, HCF, GCF is calculated and a relationship is determined as a function of club length. A club length for a first golf club belonging to the set of golf clubs is selected and club parameters for the first golf club is determined based on each determined relationship.

15 Claims, 5 Drawing Sheets

METHOD FOR DESIGNING A GOLF CLUB

TECHNICAL FIELD

The present invention relates to a method for designing a golf club for a specific golfer, comprising at least three golf clubs of different length.

BACKGROUND

Golf is a very complex game, in which two rounds of golf on the same golf course will not be identical no matter how many rounds of golf are played, but there are some fundamental conditions that always apply.

The possible length a ball will fly is controlled by the ball speed, the launch angle, and the spin generated on the ball when hit by the golf club (i.e. at impact). The ball is in turn affected by the speed of the club and the kinetic energy transfer that occurs between the golf club and the ball. It means that with the same type of hit on the ball, more speed of the club is needed to transport the ball a longer distance and less speed on the club is needed to transport the ball a shorter distance. If a golfer should be able to hit a ball as far as possible, a golf club that generates maximum speed with maintained accuracy to hit the ball needs to be provided.

Golf is not just about hitting the ball far, but also to know how far a golf club will transport the ball when hit by a golfer in order to choose the right golf club to transport a ball a desired distance. Another factor is to be able to control the direction of the ball. Furthermore, ball flight (to be able to control the roll of the ball after landing) and different types of spins are other parameters that should be considered.

A golfer is allowed to bring 14 golf clubs on to the course (of which at least one is a putter). These golf clubs have different characteristics that are used by the golfer to try and control the parameters described above. Prior art golf clubs are normally designed to have ½ inch (12.7 mm) difference between the iron clubs. The length of the driver is normally approximately 45 inches (1 143 mm).

In order to make the golf clubs feel the same way for a golfer different techniques have been developed during the years.

One technique is to balance the golf clubs in a swingweight apparatus to achieve the same swingweight for each golf club. Another technique is to design the golf clubs using MOI (Moment of Inertia) in which the golf clubs are tuned hanging from a holder and put in a pendulum motion. MOI will give a good indication of the torsional moment for the golf clubs as such, and aim of the technique is to achieve the same MOI for all golf clubs in a set, as disclosed in U.S. Pat. No. 5,769,733.

Club fitting may be performed to investigate and determine the length, lie (angle between the club head and the shaft), swingweight or MOI that is most suitable for a golfer. Club fitting is performed in advanced system in which sensors register behavior of the ball and the golf club when hitting the ball (i.e. at impact). The goal of all types of club fitting is to try and provide the golfer with equipment adapted to the golfer which will give the golfer better playing conditions.

The fundamental condition for all club fittings is that the golfer has established a muscle memory (practiced motion) such that a golf stroke with a certain golf club is good. It is also important that the golf club is manufactured in such a way that the golfer, in a physical perspective, manage to repeat the motion of the golf club in a similar way, over and over again.

A problem with prior art techniques is that although some design parameters are considered, others parameters that affect the ability to hit the ball repeatedly are not considered.

One parameter is how the swing changes when the length of the golf club is changed. Different club length will result in different stances when addressing the ball with clubs having different lengths. The angles between the upper part of the body of the golfer, the wrists and club will vary dependent on the club length, which is a clear indication that the identical swing motion cannot be achieved for golf clubs having different length.

SUMMARY OF THE INVENTION

An object with the present invention is to provide a method for determining club parameters for a set of at least two golf clubs with different length by compensating for changes in swing motion of a golfer for golf clubs having different length.

This object is achieved by a method as defined in claim 1.

An advantage with the present invention is that the golfer will be able to handle each golf club in the golf set using the golfer's natural swing motion when hitting a golf ball.

Another advantage with the present invention is that the golfer does not need to adjust the swing motion to the length of each golf club in a set, as is the case with prior art equipment.

Further objects and advantages may be found by a skilled person in the art from the detailed description.

BRIEF DESCRIPTION OF DRAWINGS

The invention will be described in connection with the following drawings that are provided as non-limited examples, in which.

DETAILED DESCRIPTION

The fundamental principal of the invention relates to how the human body affects the ability to play golf. In a closer analysis of the forces applied to the human body when swinging a golf club, the muscles may be divided into large muscle groups and small muscle groups. The large muscle groups perform the heavy work and the small muscle groups handle the fine details. They work together during a golf stroke to create a homogenous motion. In order for a golf club to be good, it needs to be in tune with both large and small muscle groups.

The tuning of the muscle groups in the prior art methods, as described above, in order to design or adapt golf clubs will not be true for all the golf clubs in a set. Every now and then, a golf club is found, e.g. an iron 7, that is very well adapted to a specific golfer, but a gradually deteriorating adaptation is present for the longer and shorter clubs in the set.

Figure 1:
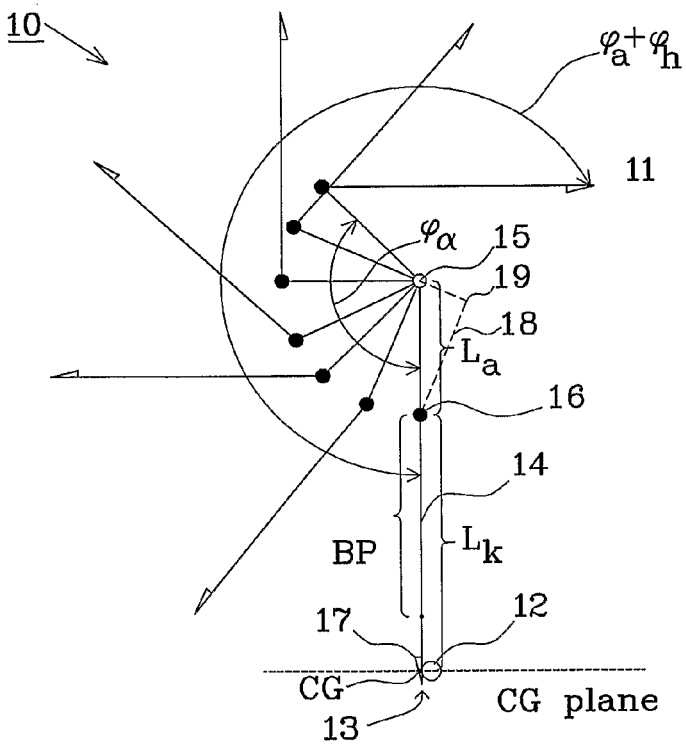
FIG. 1 shows an example of a swing motion.

The theoretical background to the concept of the invention is to see what happens, and what should happen, when a golfer hits a ball with a golf club. Everything in golf that occurs up to the point when the swing motion starts are preparations in order for the golfer to be able to perform a golf stroke as intended. These preparations include analysis of the ball's position, choice of the type of stroke that is applicable, choice of golf club, and line of play. The golfer then moves into position to hit the ball, i.e. takes the stance. FIG. 1 illustrates a swing motion 10 of a golfer when hitting a ball. The swing motion starts at a top position 11 and moves towards the ball 12 which is placed in a bottom position 13. Energy transfer between a golf club 14, having a club length $L_k$, and the ball 12 occurs during impact at the bottom position 13.

A distance $L_a$ between the upper part 16 of the golf club 14 and the rotational centre 15 of swing motion, which distance is related to the arm length of the golfer, is considered to be constant during the swing motion. The arm length of the golfer (18) and the length from the shoulder socket (19) to the rotational centre (15) are sides in a triangle, and $L_a$ is the hypotenuse of the triangle. The swing motion also depends on a number of variables, such as the position of the balance point BP in relation to the upper part 16 of the golf club 14, which are going to be described in more detail below.

Figure 3A:
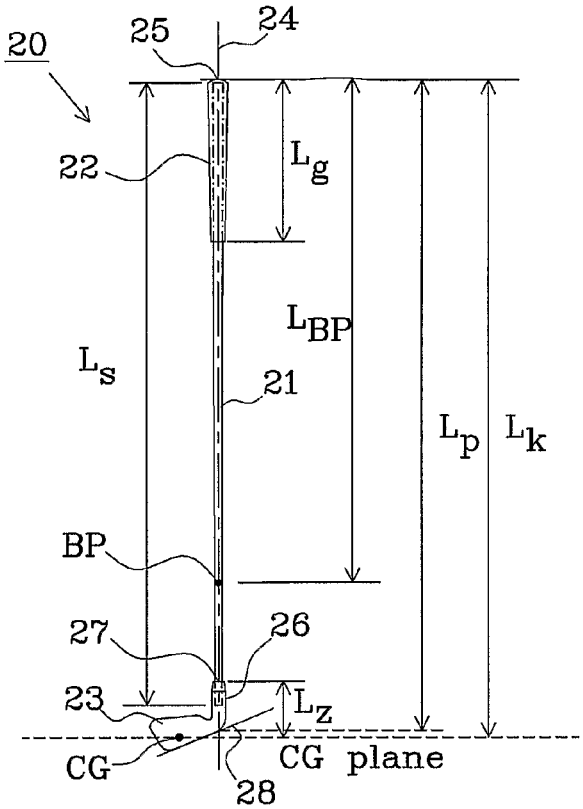
FIG. 3*a* shows a side view of a golf club.

The golf club comprises a grip section (not shown), a shaft (not shown), and a golf head 17 having a centre of gravity CG. A CG plane, which is perpendicular to a direction along the centre of the shaft, is illustrated with a dashed line through CG of the golf head 17 (see also description in connection with FIG. 3*a*). The club length $L_k$ is defined as the distance from the upper part 16 to the CG plane. It is also possible to define the club length $L_k$ and the distance $L_a$ in another way, e.g. a predetermined distance down on the grip section, e.g. 6 inches (152.4 mm) down from the upper part 16 of the golf club 14. However, in this description the definition described in connection with FIGS. 1 and 3*a* is used.

It should be noted that the swing motion does not end at impact, i.e. the bottom position (13), but continuous forward in an anti-clockwise direction as the golfer swings through. This is, however, not shown in FIG. 1 for sake of clarity.

The muscles of the golfer have been loaded with energy at the top position 11 to perform a golf stroke, and the muscles have been discharged at the bottom position 13 to generate energy to the golf stroke. The muscles may, as mentioned above, be divided into large muscles groups and small muscle groups. The large muscles groups are considered to be related to the body of the golfer, and the small muscle groups are considered to be related to the wrists (and to some extent the arms) of the golfer. The golf swing is a motion with an even acceleration from the top position 11 to the bottom position 13, where the golf club hits the ball 12.

The torsional moments that the muscles need to generate, in order to transfer energy to the ball at the bottom position, may be analyzed and be divided into a first torsional moment, herein referred to as PCF (Plane Control Factor), and a second torsional moment, herein referred to as ICF (Impact Control Factor). These quantities may be expressed in mathematical equations:

$$PCF=(L_a+L_{BP})\cdot a_{BP}\cdot m_k \tag{1}$$

$$ICF=L_{BP}\cdot(a_{BP}-a_h)\cdot m_k \tag{2}$$

wherein $L_a$ is a constant (related to the arm length of the golfer), $L_{BP}$ is the balance point length from the upper part 16 of the golf club 14 to the balance point BP of the golf club 14, $a_{BP}$ is the acceleration in the balance point BP, $a_h$ is the acceleration in the wrists of the golfer (which are considered to be positioned at the upper part 16 of the golf club 14), and $m_k$ is the club weight.

ICF may also be expressed as functions of balance point length $L_{BP}$ and club weight $m_k$ by inserting the acceleration of the balance point reduced by the acceleration of the wrists into equation (2) as described in the co-pending Swedish patent application SE0702905-1 and the corresponding pending US application with publication number US 2010/0255925, hereby incorporated by reference, which results in:

$$ICF\propto m_k\cdot(L_{BP})^2 \tag{3}$$

In an MOI matched set of golf clubs, ICF is kept constant between the golf clubs, but this is not the optimal selection due to the change in swing motion by the golfer when the length of the golf club is altered.

Thus, MOI is based on the following relationship between a first golf club and a second golf club within a golf set:

$$m_{k,1}(L_{BP,1})^2=m_{k,2}(L_{BP,2})^2, \tag{4}$$

Figure 2:
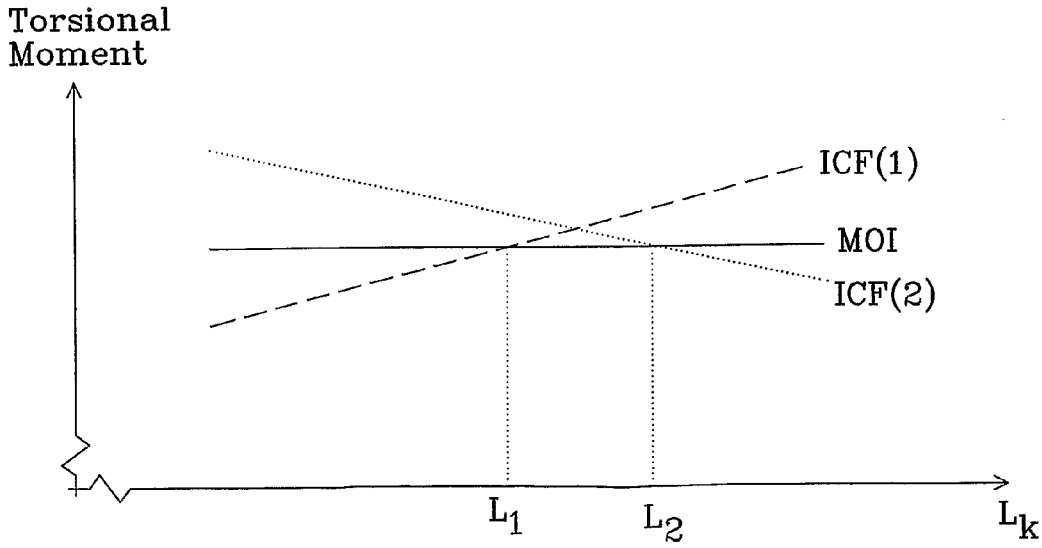
FIG. 2 shows a graph that illustrates the difference between a prior art matching (MOI) and the invention.

This is illustrated in FIG. 2. The continuous line illustrates an MOI matched set of golf clubs having different lengths $L_k$. The torsional moment ICF is constant for every length.

Contrary to MOI, the relationship between the first golf club and the second golf club within a golf set that is adapted for a golfer will be:

$$m_{k,1}(L_{BP,1})^2=\alpha\cdot m_{k,2}(L_{BP,2})^2, \alpha\neq 1 \tag{5}$$

wherein $\alpha$ represents a linear constant, $m_{k,1}$ is the weight and $L_{BP,1}$ is the balance point length of the first golf club; and $m_{k,2}$ is the weight and $L_{BP,2}$ is the balance point length of the second golf club. The torsional moment ICF between golf clubs in a set of clubs designed for a golfer will differ from the continuous line of MOI as illustrated by the inventive method. ICF(1) illustrated by a dashed line has $\alpha<1$ as a function of club length, and ICF(2) illustrated by a dotted line has $\alpha>1$ as a function of club length.

The ICF(1) curve cross the MOI curve at a first club length $L_1$, and the ICF(2) curve cross the MOI curve at a second club length $L_2$, which indicate that an MOI matched club with a club length equal to $L_1$ or $L_2$ will have the same ICF as a designed golf club based on the inventive method. It should also be noted that the MOI curve does only cross each ICF curve at one club length, i.e. ICF(1) at $L_1$, and ICF(2) at $L_2$.

PCF may be expressed by inserting the acceleration of the balance point into equation (1) as described in the co-pending Swedish patent application SE0702905-1, which results in:

$$PCF\propto(L_a+L_{BP})\cdot(L_a+2\cdot L_{BP})\cdot m_k \tag{6}$$

The torsional moment PCF is a linear function of balance point length $L_{BP}$, and also a function of club length $L_k$ since the location of the balance point is dependent on the club length, whereby the relationship between two golf clubs in a set adapted for a golfer may be expressed as:

$$m_{k,1}(L_{BP,1}+L_a)\cdot(2L_{BP,1}+L_a)=\delta\cdot m_{k,2}(L_{BP,2}+L_a)\cdot(2L_{BP,2}+L_a);\ \delta\neq 1, \tag{7}$$

wherein δ represents a linear constant, $m_{k,1}$ is the weight and $L_{BP,1}$ is the balance point length of the first golf club; $m_{k,2}$ is the weight and $L_{BP,2}$ is the balance point length of the second golf club, and $L_a$ is the constant related the golfer's arm length.

Figure 4:
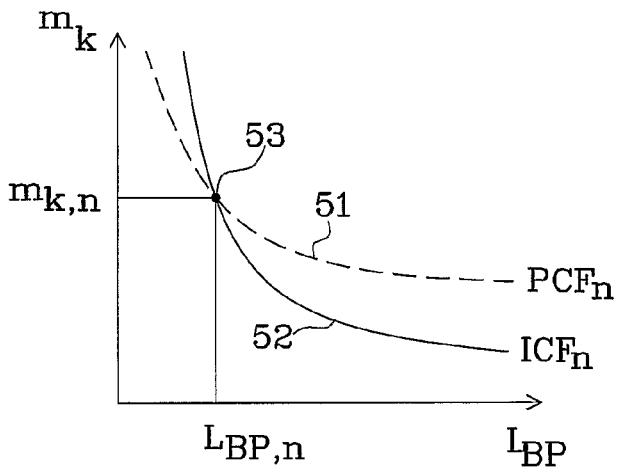
FIG. 4 shows a graph illustrating the behaviour of the first and the second torsional moment as a function of the balance point length according to the invention.

FIG. 4 shows a first graph in which the behaviour of the first torsional moment PCF and the second torsional moment ICF is presented as a function of the balance point length and club weight according to the invention. A first curve 51 (dashed) illustrates equation (6) and a second curve 52 (continuous) illustrates equation (3), when $L_a$ is constant, and $m_k$ and $L_{BP}$ are varied. The curves intersect at a point 53 which gives only one balance point length $L_{BP,n}$ and a corresponding club weight $m_{k,n}$ for a golf club "n" when both equations are fulfilled. One aspect of the inventive method is to identify the relevant parameters, i.e. $m_k$ and $L_{BP}$, of two or more golf clubs having different club lengths to establish the linear constants, α and δ, of equations (5) and (7).

Furthermore, it is desired to be able to control the angle of the golf club head 17 related to the swing plane when hitting the ball 12, and to hit a straight shot. In order to achieve this, the angle needs to be perpendicular to the swing plane at impact, i.e. the golf head needs to be square. The shaft and grip section are cylindrical and do not influence the torsional moments applied to the wrists at impact, but the club head will affect the ability to control the golf club.

The torsional moments the muscles need to generate, in order to be able to control the angle at the bottom position, may be analyzed and be divided into a third torsional moment, herein referred to as HCF (Head Control Factor), and a fourth torsional moment, herein referred to as GCF (Gear Control Factor). These quantities may be expressed in mathematical equations:

$$HCF=L_k\cdot(a_{CG}-a_h)\cdot m_{kh} \tag{8}$$

$$GCF=L_{CG}\cdot(a_{CG}-a_h)\cdot m_{kh} \tag{9}$$

wherein $L_k$ is the length of the golf club; $L_{CG}$ is a length of a vector from a point in the CG plane in the prolongation of the centre of the shaft the upper part 16 of the golf club 14 to a point on a line drawn through a sweet spot on the ball-striking surface and the centre of gravity CG, preferably to the CG, of the golf head 17; $a_{CG}$ is the acceleration in CG; $a_h$ is the acceleration in the wrists of the golfer (which are considered to be positioned at the upper part 16 of the golf club 14); and $m_{kh}$ is the club head weight.

FIGS. 3*a*-3*d* illustrate different important definitions for calculating HCF and GCF, as well as a more detailed definition of balance point length needed in calculating PCF and ICF, as described above.

FIG. 3*a* shows a side view of a golf club 20 comprising a shaft 21 with a shaft length $L_s$, a grip section 22 with a grip length $L_g$, and a club head 23 with a centre of gravity CG. The golf club has a balance point BP, and a balance point length $L_{BP}$ is defined as a distance from a distal end 25 of the grip section 22 to the balance point in a first direction defined along a centre line 24 of the shaft 21. The centre of gravity CG is defined to be arranged in a plane (CG plane) perpendicular to the first direction, and a club length $L_k$ is defined as a distance from the distal end 25 of the grip section 22 to the CG plane along the first direction. A play length $L_p$, which is the club length experienced by the golfer when swinging the golf club, is defined as the distance from the distal end of the grip section 22 to the ground (illustrated with line 28) when the centre of the sole of the club head is touching the ground 28. Normally $L_p$ is approximately equal to $L_k$ unless CG is positioned very low (as in FIG. 3*a*) or very high in the club head 23.

The club head 23, having a club head weight $m_{kh}$, is provided with a hosel 26 and a hosel bore in which the shaft 21 is attached. The position of the CG is in this description defined in relation to a centred point 27 at the top of the hosel 26, and may be expressed in three components $L_x$, $L_y$, and $L_z$. The third component $L_z$ is defined along the first direction from the centred point 27 to the CG plane, see FIG. 3*a*. The first $L_x$ and second $L_y$ components are arranged in the CG plane and defined as illustrated in FIGS. 3*b* and 3*c*.

Figure 3D:
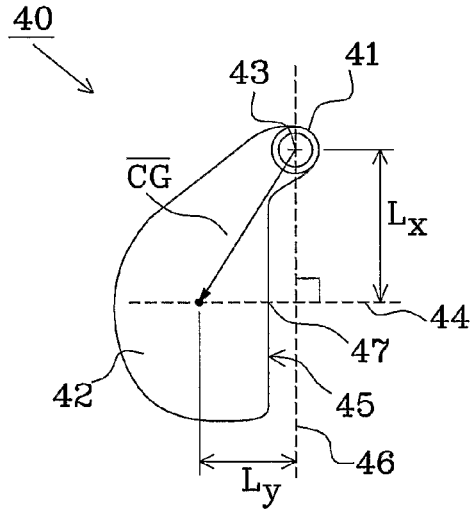
FIG. 3*d* shows a top view of a second type of club head.
Figure 3B:
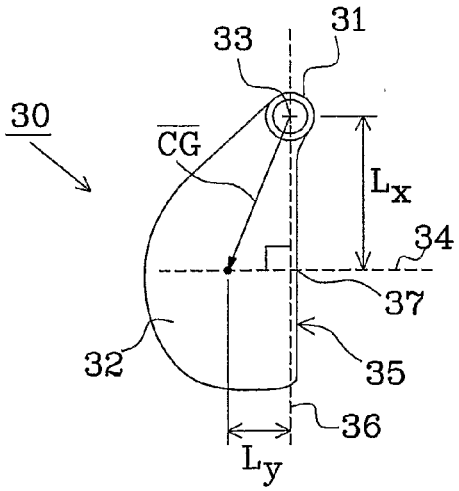
FIG. 3*b* shows a top view of a first type of club head.
Figure 3C:
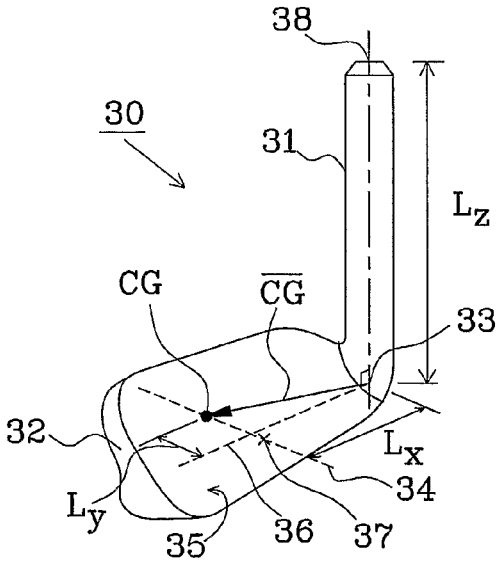
FIG. 3*c* shows a perspective view of the first type of club head in FIG. 3*b*.

FIG. 3*b* shows a top view and FIG. 3*c* shows a perspective view of a conventional club head 30 having a hosel 31 with a hosel bore and a club blade 32. A zero point 33 is indicated in the hosel 31 and is defined as the point in the CG plane where the prolongation of the centre line 24 of the shaft 21 intersects the CG plane. The $L_z$ component is defined as the distance from a centred point 38 at the top of the hosel 31 to the zero point 33, and a vector $\overline{CG}$ is defined between the zero point 33 and CG. The vector may be divided into the first $L_x$ and second $L_y$ components as mentioned above. $L_x$ is defined as the distance between zero point 33 and a line 34 passing through CG and is perpendicular to the face of the ball striking surface 35 of the club head 30. $L_y$ is defined as the distance between CG and a line 36 passing through the zero point 33 and is parallel to the face of the ball striking surface 35 of the club head 30. The point 37 where line 34 intersects with the ball striking surface 35 is normally called "sweet spot", as the centre of gravity CG is arranged directly behind that point during impact (at bottom position in FIG. 1) provided the club head is square. For a conventional club head, the distance to the sweet spot 37 from CG is in this embodiment larger than $L_y$, as indicated in FIG. 3*b*.

FIG. 3*d* shows a perspective view of a club head 40 with an offset hosel design comprising a hosel 41 and a club blade 42. A zero point 43 is indicated in the hosel 41, defined in the same way as in FIG. 3*b*. A vector $\overline{CG}$ is defined between the zero point 43 and CG, and the vector may be divided into the first $L_x$ and second $L_y$ components as mentioned above. $L_x$ is defined as the distance between zero point 43 and a line 44 passing through CG and is perpendicular to the face of the ball striking surface 45 of the club head 40. $L_y$ is defined as the distance between CG and a line 46 passing through the zero point 43 and is parallel to the face of the ball striking surface 45 of the club head 40. The distance to a sweet spot 47 is in this embodiment shorter than $L_y$.

It should be noted, in order to calculate the fourth torsional moment GCF, it is preferred that the CG length $L_{CG}$ is the length of the vector $\overline{CG}$ due to the fact that the position of CG will affect the feeling of the golf club during the swing motion. Alternatively, the first component $L_x$ may be used as CG length $L_{CG}$ due to the fact that CG will be positioned directly behind the sweet spot 37, 47 at impact, but any point on the line 34, 44, that passes through CG and sweet spot 37, 47 may be used as $L_{CG}$ to calculate GCF.

HCF according to equation (8) is a function of club length $L_k$, the club head weight $m_{kh}$, and the acceleration difference in CG and the wrists ($a_{CG}-a_h$). The acceleration difference ($a_{CG}-a_h$) may be expressed as a function club length, as described in the co-pending Swedish patent application SE0702905-1, which results in:

$$HCF\propto(L_k)^2\cdot m_{kh} \tag{10}$$

Figure 5:
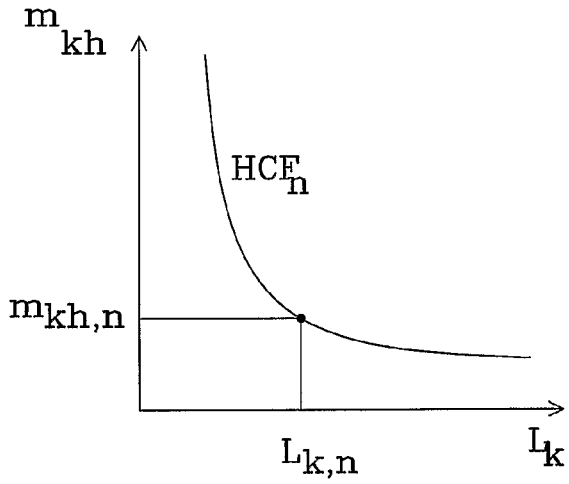
FIG. 5 shows a graph illustrating the behaviour of the third torsional moment as a function of club head weight and club length according to the invention.

FIG. 5 shows graph illustrating the behaviour of the third torsional moment $HCF_n$ as a function of club length $L_k$ and club head weight $m_{kh}$ for golf club "n". A given value for $HCF_n$ for a golf club "n" results in the freedom to choose a club length $L_{k,n}$ for that golf club that will result in a desired club head weight $m_{kh,n}$, or a club head weight $m_{kh,n}$ may be chosen that will result in a desired club length $L_{k,n}$, to obtain an optimal Head Control Factor.

The inventive concept is based on the understanding that golfers alter the swing dependent on the golf club length $L_k$ and thus the third torsional moment HCF may also change since it is proportional to the square of the club length as expressed in equation (10). Therefore it is possible to form a relationship between a first golf club and a second golf club having different lengths in the set of golf clubs:

$$m_{kh,1}(L_{k,1})^2=\beta\cdot m_{kh,2}(L_{k,2})^2 \quad (11)$$

wherein $m_{kh,1}$ is the head weight and $L_{k,1}$ is the club length of a first golf club; and $m_{kh,2}$ is the head weight and $L_{k,2}$ is the club length of a second golf club. For a golfer, β normally differs from one ($\beta\neq1$) but it is conceivable that a golfer will require a set of golf clubs in which the golf clubs have the same HCF although they have different length, i.e. $L_{k,1}\neq L_{k,2}$.

Similarly, the fourth torsional moment GCF may, by introducing the acceleration difference between the wrists and the CG as described in the co-pending Swedish patent application SE0702905-1, be expressed as:

$$GCF\propto L_k\cdot L_{CG}\cdot m_{kh} \quad (12)$$

Figure 6:
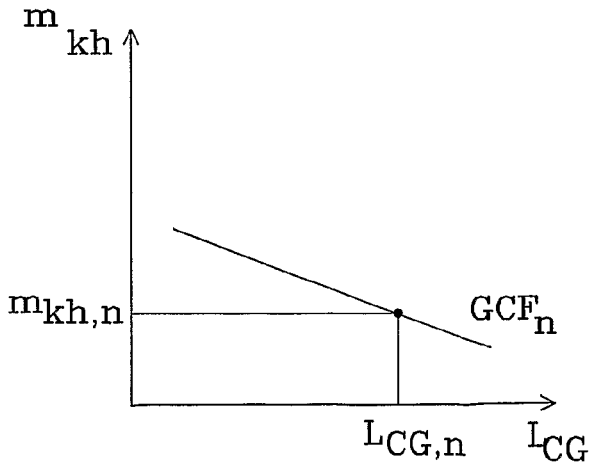
FIG. 6 shows a graph illustrating the behaviour of the fourth torsional moment as a function of club head weight and CG length according to the invention.

FIG. 6 shows a graph illustrating the behaviour of the fourth torsional moment $GCF_n$ for a golf club having a predetermined club length $L_{k,n}$ as a function of CG length $L_{CG}$ and club head weight $m_{kh}$ for golf club "n". A given value for $GCF_n$ for a golf club "n" having a predetermined club length $L_{k,n}$ results in the freedom to choose CG length $L_{CG,n}$ for that golf club that will result in a desired club head weight $m_{kh,n}$, or a club head weight $m_{kh,n}$ may be chosen that will result in a desired CG length $L_{CG,n}$, to obtain an optimal Gear Control Factor.

The inventive concept is, as mentioned above, based on the understanding that golfers alter the swing dependent on the golf club length $L_k$ and thus the fourth torsional moment GCF may also change since it is proportional to the club length as expressed in equation (12). Therefore it is possible to form a relationship between a first golf club and a second golf club having different lengths in the set of golf clubs:

$$m_{kh,1}\cdot L_{k,1}\cdot L_{CG,1}=\gamma\cdot m_{kh,2}\cdot L_{k,2}\cdot L_{CG,2} \quad (13)$$

wherein $m_{kh,1}$ is the head weight, $L_{k,1}$ is the club length and $L_{CG,1}$ is the CG length of the first golf club; and $m_{kh,2}$ is the head weight, $L_{k,2}$ is the club length and $L_{CG,2}$ is the CG length of the second golf club. For a golfer, γ normally differs from one ($\gamma\neq1$) but it is conceivable that a golfer will require a set of golf clubs in which the golf clubs have the same GCF although they have different length, i.e. $L_{k,1}\neq L_{k,2}$.

From equation (11) and equation (13) it is obvious that HCF and GCF are not based on the club weight $m_k$ or balance point length $L_{BP}$ for different golf clubs within the same set of golf clubs. Similarly, from equation (7) and equation (5) it is obvious that PCF and ICF are not based on the club head weight $m_{kh}$ or CG length $L_{CG}$ for different golf clubs within the same set of golf clubs. It should also be noted that PCF and ICF are not directly based on club length $L_k$ either, but one of the fundamental feature of the inventive method is to determine the different parameters to design a golf club having an arbitrary length and being adapted for a specific golfer since the swing motion will differ when the club length is changed.

Figure 7:
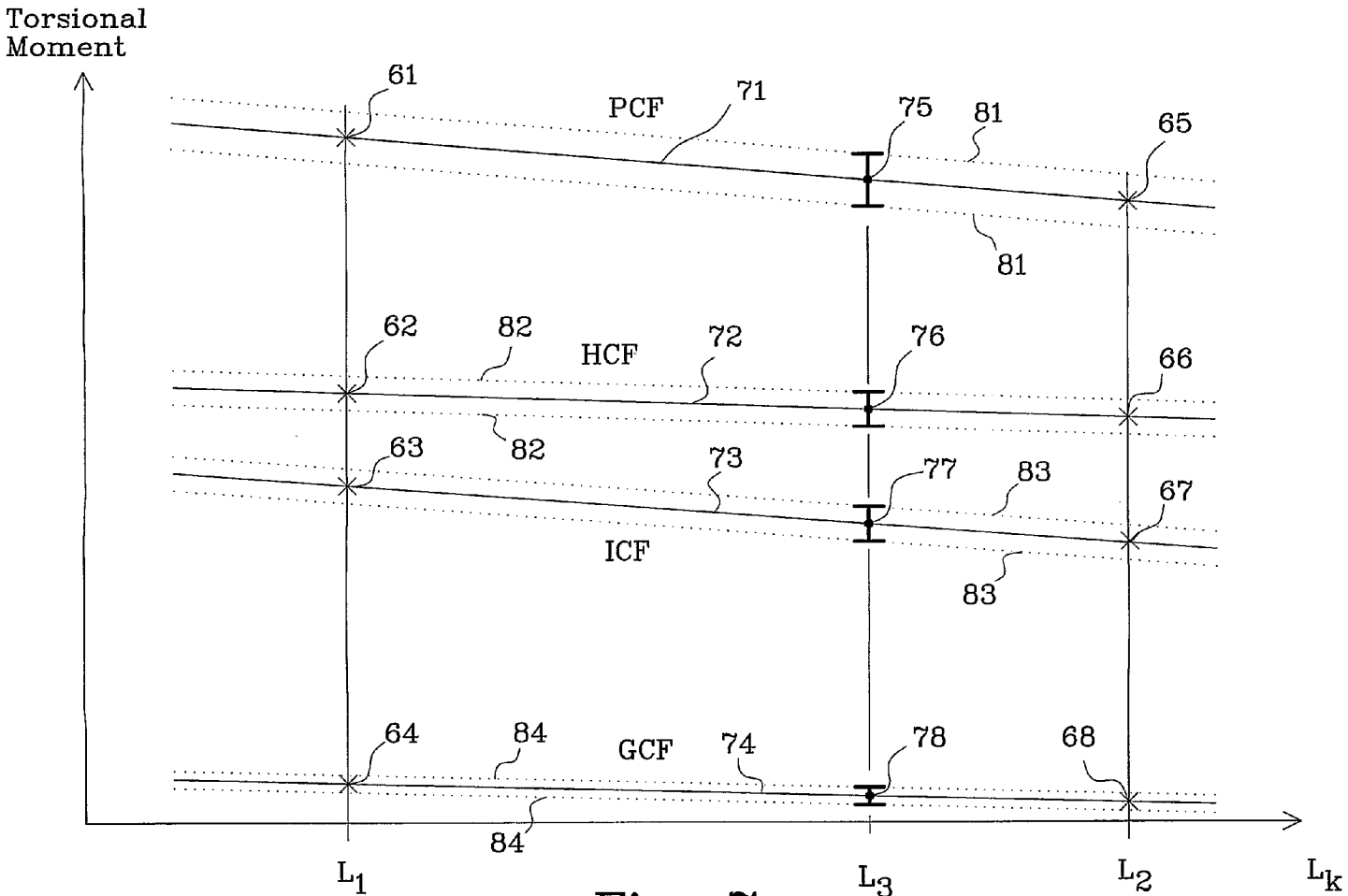
FIG. 7 shows an example of four different torsional moments as a function of club length according to the invention.

FIG. 7 shows a graph illustrating the four torsional moments discussed above. The x-axis should represent the play lengths $L_p$ of different clubs within a golf set, but the club length $L_k$ is used in FIG. 7 since $L_p$ is considered to be approximately equal to the club length $L_k$ in the examples. The y-axis represents the torsional moment for PCF, HCF, ICF and GCF. Generally, PCF (line 71) is approximately twice as high as ICF (line 73) when the balance point length and club weight is selected to fulfil equation (6) and equation (3), which is illustrated by point 53 in FIG. 4. HCF (line 72) is normally higher than ICF, and GCF (line 74) is approximately 1-2% of PCF.

Target values for golf club parameters, as described in the example below, may be derived from the torsional moments and the relationships described above. Two or more golf clubs are preferably tried out under the supervision of a club maker, to determine the golf club parameters needed to establish the slope of the torsional moments as a function of club length. Parameters related to a swing motion needs to be determined, either by measuring them in a golf analyzer equipment for a specific golfer or by using standard values related to the swing motion. The swing motion parameters are then used for all golf clubs in the golf set even though the club lengths will differ. The golf club parameters are tied to the relationships established by equation (4), equation (7), equation (11) and equation (13).

Main Example

The following example illustrates the concept to create a set of golf clubs having optimal properties taking all four torsional moments into consideration. This is a non-limited example, and the values presented below will vary for each golfer.

In FIG. 7, points 61, 62, 63 and 64 illustrate the established, torsional moment for PCF, HCF, ICF and GCF, respectively, for a first reference golf club with club length $L_1$ and points 65, 66, 67 and 68 illustrate the established, torsional moment for PCF, HCF, ICF and GCF, respectively, for a second reference golf club with club length $L_2$. Straight lines 71, 72, 73 and 74 are drawn between the points representing PCF, HCF, ICF and GCF, respectively. If three or more golf clubs are used as reference golf clubs, then the lines 71-74 preferably are drawn between the points according to a least square method. This means that a square of the deviation of each point from a point on its corresponding straight line is calculated and the sum of all deviations should be as small as possible. In an example, only two golf clubs are used as references and the straight lines 71-74 may then be drawn through each point as illustrated in FIG. 7. In this example the first reference golf club with the club length $L_1$ is a 5 metalwood, the second reference golf club with the club length $L_3$ is a 9 iron.

The slope of the straight lines 71-74, i.e. α, β, δ, γ, are obtained by a method according to the present invention, wherein at least two golf clubs are tried out under the supervision of a club maker to determine parameters related to the golf clubs, such as:

club weight ($m_k$),
club length ($L_k$),
balance point length ($L_{BP}$),
club head weight ($m_{kh}$), and
CG length ($L_{CG}$)

for each golf club. The method of trying out golf clubs includes analyzing the ability to handle the golf clubs in order to consistently hit a ball and transport the ball close to a point repeatedly, i.e. approximately the same distance and direction. These golf clubs are used as reference clubs to determine at least two points on each line representing a torsional moment, as illustrated in FIG. 7.

The ability to identify the above mentioned parameters for at least two reference clubs is essential in order to be able to establish the torsional moments as a function of club length. The present invention provides a method for determining these parameters for a golfer using a virtual swing robot as described in the Swedish patent application SE0702905-1 having the following swing parameters: the distance between wrists and the centre of rotation ($L_a$) is selected, e.g. 650 mm, and the velocity of club head is selected, e.g. 80 miles per hour (MPH) which corresponds to 35.76 meter per second (m/s) when swinging a virtual golf club with a predetermined club length, e.g. 1000 mm (39.37 inches). Furthermore, the virtual golf club has a predetermined balance point length, e.g. 772 mm, a predetermined club weight, e.g. 376.4 grams, a predetermined club head weight, e.g. 255 grams, and a predetermined CG length, e.g. 38.078 mm. The swing angles are selected, e.g. $\phi_a=\phi_h=135°$ and the virtual swing robot parameters, i.e. $a_{CG}$, $a_{BP}$, $a_h$, $v_{BP}$ and $v_h$, are calculated. The values $a_h$ and $v_h$ will be the same for all clubs since the virtual swing robot will have identical acceleration and velocity in the wrists for a golf club with arbitrary club length. The acceleration in the club head $a_{CG}$, and the acceleration and velocity in BP $a_{BP}$ and $v_{BP}$, will vary dependent on the shift in CG length and balance point length as a result of the calculated values for the different torsional moments, as described in more detail below.

Figure 8:
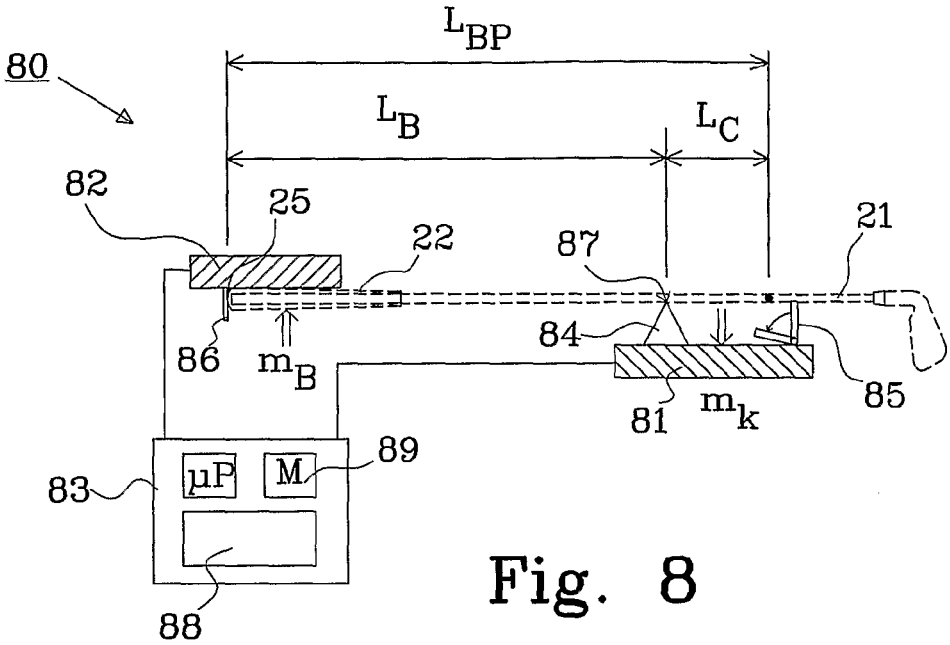
FIG. 8 shows a balance point scale for calculating ICF and PCF for a golf club.

In order to reduce the amount of manual steps, and increase the accuracy of the calculations, when calculating PCF and ICF for a golf club, as expressed in equations (1) and (2), a balance point scale 80 is shown in FIG. 8. The balance point scale 80 comprises a first scale 81, a second scale 82 and a processing unit 83. The first scale 81 comprises a fixed support 84 and a movable support 85 adapted to be moved between a vertical position and an essentially horizontal position. The second scale 82 comprises a protrusion 86, which is arranged a predetermined distance $L_B$, e.g. 550 mm, from a pivotal point 87 on the fixed support 84 of the first scale 81.

A golf club 21 (not being a part of the balance point scale), having a balance point BP, is pivotally arranged on said fixed support 84 with the distal end 25 of the grip section 22 positioned against the protrusion 86. The balance point BP will then be positioned an unknown distance $L_C$ from the pivotal point 87. The balance point scale 80 is designed to measure the total weight $m_k$ of the golf club 21 by the first scale 81 when the movable support 85 is in its vertical position, i.e. the balance point scale 80 is in fixed position, and no pressure is applied to the second scale 82, i.e. $m_B=0$. When the movable support 85 is moved from the vertical position, to the essentially horizontal position, i.e. the balance point scale 80 is in a pivot position, a pressure will be applied to the second scale 82 due to lever action, and the second scale 82 will measure a balancing weight $m_B$.

Furthermore, the processing unit 83 comprises a display 88, upon which instructions and results are displayed, a processor μP, a memory 89, and input means (not shown), such as separate buttons, pressure sensitive portions on the display, etc. to feed commands to the processing unit 83.

Figure 9:
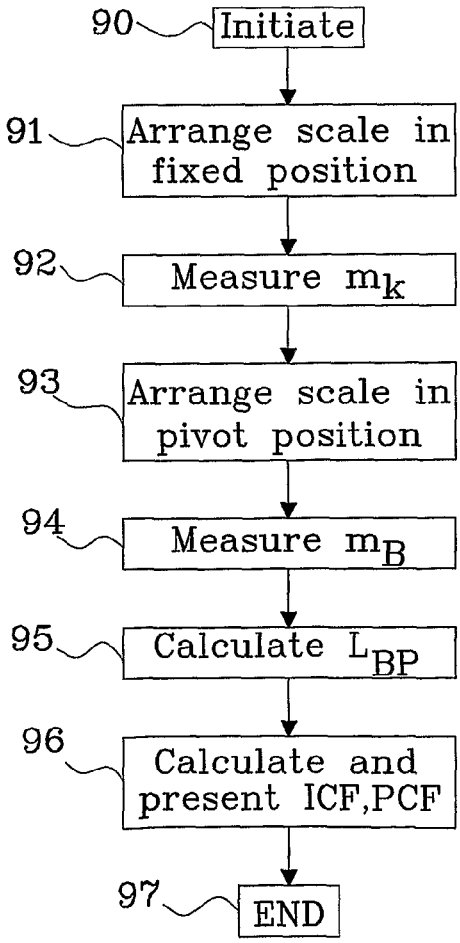
FIG. 9 shows a flow chart for operating the balance point scale in FIG. 8.

FIG. 9 shows a flow chart that describes the operating process of the balance point scale. The process starts, step 90, by feeding essential parameters into the processing unit, such as $a_{BP}$, $a_h$, and $L_a$. If no parameters are provided the processing unit will use the same parameters as used by the virtual swing robot, see above. The golf club is positioned and the movable support 85 is moved to a vertical position, which preferably automatically restarts the calculation process in the processing unit 83, and the balance point scale is thus arranged in fixed position, step 91. The total weight $m_k$ of the golf club is measured by the first scale 81 and the result is stored in the memory 89 in the processing unit 83, step 92.

Instructions to move the movable support 85 from the vertical position to enable the balancing weight to be measured may be presented on the display 88 or an audiovisual signal (light/sound) may be presented when the total weight $m_k$ of the golf club has been measured and stored. The balance point scale is thereafter arranged in pivot position by moving the movable support 85, step 93, and the balancing weight $m_B$ is then measured by the second scale 82 and stored in the memory 89, step 94.

The balance point length $L_{BP}$ is calculated using the following relationships in step 95:

$$m_B \cdot L_B = m_k \cdot L_C \Rightarrow L_C = \frac{m_B \cdot L_B}{m_k} \tag{14}$$

$$L_{BP} = L_C + L_B = L_B\left(1 + \frac{m_B}{m_k}\right) \tag{15}$$

PCF and ICF, as expressed in equation (1) and (2), may now be calculated and presented in the display 88.

In a non-limiting example a golf club is arranged on the balance point scale. The scale is arranged in the fixed position and the total weight of the golf club is measured:

$$m_k=401.7 \text{ grams}$$

The balance point scale is arranged in the pivot position and the balance weight is measured:

$$m_B=144.7 \text{ grams}$$

The balance point length of the golf club, when $L_B=550$ mm, is:

$$L_{BP} = L_B\left(1 + \frac{m_B}{m_k}\right) = 550\left(1 + \frac{144.7}{401.7}\right) = 748.1 \text{ mm}$$

Reference Clubs

The basis of the inventive method is the ability to determine the golf parameters of the reference clubs needed to establish the different relationships of the torsional moments, as described above.

The club parameters of the reference clubs needs to be identified by analyzing certain parameters, preferably using a launch monitor, since the club parameters affect one or more of the described torsional moments. These torsional moments need to be established before a custom fit golf club may be produced.

Three club parameters mainly affect the balance of the golfer, namely: length of golf club $L_k$, weight of golf club $m_k$, and balance point length, $L_{BP}$. One golf parameter mainly affects the ability to control the golf club, namely: CG length $L_{CG}$. These golf parameters, as well as the club head weight $m_{kh}$, shaft weight $m_s$ and grip weight $m_g$ have an impact on the described torsional moments PCF, ICF, HCF and GCF as follows.

The analysis is based on that the following club parameters are non-changing: club length $L_k$, and grip weight $m_g$. Furthermore, the arm length of the golfer $L_a$ is naturally constant for a golfer.

PCF

PCF is primarily affected by shaft weight $m_s$, and secondarily affected by balance point length $L_{BP}$ when the club length $L_k$ is kept constant. The shaft weight $m_s$ is part of the club weight (see equation 32) and preferably the total weight of the golf club and the position of the balance point BP are varied during the analyses to identify the following parameters:

club speed at impact, spread angle (or swing track of golf club), swing tempo.

These parameters determine the ability to reproducibly swing the golf club and should be approximately the same (constant) between strokes made by the same golf club.

ICF

ICF is primarily affected by club head weight $m_{kh}$, and secondarily affected by the shaft weight $m_s$. The total weight and balance point length need to be maintained in order not to change PCF when the head weight is adjusted during the analyses to identify the following parameters:

launch angle of the ball at impact, spin of the ball (both back spin and side spin), carry distance of ball, ball speed at impact, club speed at impact.

All these parameters should be approximately the same (constant) between strokes made by the same golf club.

GCF

GCF is primarily affected by the CG length $L_{CG}$, and secondarily affected by the club head weight $m_{kh}$. These are varied during analysis to identify the following parameters:

launch angle of the ball at impact, which should be the approximately the same (constant) between strokes made by the same golf club at the same speed.

side spin of the ball, which should be approximately the same, and in the same direction, when the golfer hit the ball with both soft and hard strokes, i.e. different club speed at impact.

These parameters determine the direction stability of the golf ball, i.e. the ability to close the club head.

HCF

HCF is primarily affected by club head weight, which normally is provided by the analysis of GCF and affects the following parameter:

ball impact position, i.e. the point of impact by the ball on the ball striking surface of the club head during a stroke, which should be approximately the same between strokes made by the same golf club at different speeds.

Ideally, all parameters should be constant when a golfer hit the ball but in order to identify club parameters it will be sufficient if the parameters deviate not more than 10% from each other.

All torsional moments are preferably used to determine the club parameters, and the analysis of the different parameters usually needs to be performed in an iterative process since a change in club head weight when analyzing the parameters for GCF will affect the torsional moment for i.e. ICF, which in turn will affect the balance point position and thereby PCF.

PCF, ICF, HCF and GCF may now be calculated (based on the determined swing motion) for the reference clubs using equation (1), (2), (8) and (9), respectively, and the result is thereafter presented in a graph as a function of club length $L_k$, see FIG. 7. In this example the virtual swing robot, as described above, is used to create the swing motion. Table 1 shows two reference clubs with club parameters and calculated torsional moments.

TABLE 1

Reference club parameters and calculated torsional moments

| | Measured club parameters | | | | | Calculated Torsional Moments | | | |
|---|---|---|---|---|---|---|---|---|---|
| Club | $m_k$ [gram] | $L_{BP}$ [mm] | $L_k$ [mm] | $m_{kh}$ [gram] | $L_{CG}$ [mm] | PCF [Nm] | ICF [Nm] | HCF [Nm] | GCF [Nm] |
| Ref #1 | 343.5 | 802 | 1034 | 234.7 | 30.89 | 43.431 | 17.071 | 19.388 | 0.579 |
| Ref #2 | 408.0 | 743 | 930 | 298.9 | 34.35 | 46.899 | 17.403 | 19.974 | 0.738 |

The slope for each line is:

$$\delta = \frac{PCF(L_2) - PCF(L_1)}{L_2 - L_1} = \frac{46.9 - 43.4}{930 - 1034} = \frac{3.5}{-104} = -33.6 \cdot 10^{-3} \quad \text{(Line 71)}$$

$$\beta = \frac{HCF(L_2) - HCF(L_1)}{L_2 - L_1} = \frac{20.0 - 19.4}{930 - 1034} = \frac{0.6}{-104} = -5.77 \cdot 10^{-3} \quad \text{(Line 72)}$$

$$\alpha = \frac{ICF(L_2) - ICF(L_1)}{L_2 - L_1} = \frac{17.4 - 17.1}{930 - 1034} = \frac{0.3}{-104} = -2.88 \cdot 10^{-3} \quad \text{(Line 73)}$$

$$\gamma = \frac{GCF(L_2) - GCF(L_1)}{L_2 - L_1} = \frac{0.738 - 0.579}{930 - 1034} = \frac{0.159}{-104} = -1.53 \cdot 10^{-3} \quad \text{(Line 74)}$$

Building a Costum Fit Golf Club having Arbitrary Club Length

Target values for PCF, HCF, ICF and GCF are calculated when a length ($L_3$) of a golf club is selected, e.g. $L_3$=965 mm for a 5 iron. The following target values for the torsional moments will then be calculated using the above mentioned slope:

$$PCF(L_3)=45.732$$

$$HCF(L_3)=19.777$$

$$ICF(L_3)=17.291$$

$$GCF(L_3)=0.684$$

The target values, 75, 76, 77 and 78, respectively, are indicated with a filled circle on each straight line, and a maximum deviation from each target value is also indicated.

The actual PCF value of the resulting golf club may vary between the dotted lines 81 which results in a deviation that preferably is less than ±0.5%, more preferably less than ±0.2%, of the target value 75. The actual HCF value of the resulting golf club may vary between the dotted lines 82 which results in a deviation that preferably is less than ±1%, more preferably less than ±0.5%, of the target value 76. The actual ICF value of the resulting golf club may vary between the dotted lines 83 which results in a deviation that preferably is less than ±1%, more preferably less than ±0.5%, of the target value 77. The actual GCF value of the resulting golf club may vary between the dotted lines 84 which results in a deviation that preferably is less than ±5%, more preferably less than ±2%, of the target value 78.

Furthermore, target values for some golf club parameters are also calculated when the club length is selected, e.g. target values for club weight, balance point length, golf head weight and CG length, using the relationships established between the torsional moments and the golf club parameters, as illustrated in table 2.

TABLE 2

Target values for a 5 iron having club length = 965 mm.

| | Target club parameters | | | | | Target Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 5 iron | 965 | 761.4 | 386.0 | 274.9 | 30.89 | 45.732 ± 0.229 | 17.291 ± 0.173 | 19.777 ± 0.198 | 0.684 ± 0.034 |

The 5 iron golf club is then assembled with relevant components, such as shaft, club head, and grip, having actual values being as close as possible to the target values. The actual values are then used to calculate the torsional moments using equation (1), (2), (8) and (9). The actual values and calculated torsional values are presented in table 3.

TABLE 3

Actual values for a 5 iron having club length = 965 mm and calculated torsional moments.

| | Actual club parameters | | | | | Calculated Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 5 iron | 965 | 761.4 | 386.0 | 274.9 | 33.39 | 45.731 | 17.290 | 19.787 | 0.685 |

It should be noted that the calculated values differ from the target values for the torsional moments even though the actual club parameters is identical to the target values for the club parameters, since the calculated torsional moments are calculated from the actual club parameters and the target torsional moments are obtained from the straight lines generated by the reference clubs.

The club weight $m_k$ is a summation of club head weight $m_{kh}$, shaft weight $m_s$ and grip weight $m_g$:

$$m_k = m_{kh} + m_s + m_g \Rightarrow m_s = m_k - m_g - m_{kh} \tag{32}$$

Furthermore the balance point length $L_{BP}$ depends on a grip balance point length $L_{BP,g}$, the grip weight $m_g$, a shaft balance point length $L_{BP,S}$, the shaft weight $m_s$, the club length $L_k$, the club head weight $m_{kh}$ and the club weight $m_k$. $\Delta_g$ is the thickness of the grip butt-end, which normally is approximately 5 mm.

$$m_k \cdot L_{BP} = m_g \cdot L_{BP,g} + m_s \cdot (L_{BP,s} + \Delta_g) + m_{kh} \cdot L_k \Rightarrow L_{BP,s} = \frac{m_k \cdot L_{BP} - m_g \cdot L_{BP,g} - m_{kh} \cdot L_k}{m_s} - \Delta_g \tag{33}$$

The grip section is preferably a standard grip having a predetermined weight and balance point length, the club weight, club length, balance point length and club head weight are known. The shaft weight and the shaft balance point length may be determined from equation (32) and (33).

TABLE 4

Actual parameters for components of a 5 iron golf club ($\Delta_g$ = 5 mm).

| Club | $L_k$ [mm] | $m_{kh}$ [grams] | $L_{CG}$ [mm] | $m_g$ [grams] | $L_{BP,g}$ [mm] | $L_{BP,s}$ [mm] | $m_s$ [grams] | $m_k$ [grams] | $L_{BP}$ [mm] |
|---|---|---|---|---|---|---|---|---|---|
| 5 iron | 965 | 274.9 | 33.39 | 45 | 90 | 367.2 | 66.1 | 386.0 | 761.4 |

The swingweight for the assembled 5 iron may now be calculated using the swingweight formula:

$$\text{swingweight} = (L_{BP}(\text{inches}) - 14'') \cdot m_k(\text{ounces}) = \left(\frac{L_{BP}(\text{mm})}{25.4} - 14\right) \cdot \frac{m_k(\text{mm})}{28.35} \tag{34}$$

The swingweight for the assembled 5 iron is 217.5 [in oz], which corresponds to D 2.3 in a swingweight table.

The set of golf clubs may naturally comprise more than three golf clubs, and the example below seven golf clubs (3 iron-9 iron) are built based on the straight lines 71-74 describing the torsional moments. The following target values are obtained:

TABLE 5

Target values for 3 iron-9 iron based on the reference clubs in table 1.

| | Target club parameters | | | | | Target Torsional Moments | | | |
|---|---|---|---|---|---|---|---|---|---|
| Club | $L_k$ [mm] | $L_{BP}$ [mm] | $m_k$ [gram] | $m_{kh}$ [gram] | $L_{CG}$ [mm] | PCF [Nm] | ICF [Nm] | HCF [Nm] | GCF [Nm] |
| 3 iron | 990 | 775.5 | 370.4 | 259.3 | 32.58 | 44.898 | 17.211 | 19.636 | 0.646 |
| 4 iron | 978 | 768.6 | 377.9 | 266.6 | 32.99 | 45.299 | 17.250 | 19.704 | 0.666 |
| 5 iron | 965 | 761.4 | 386.0 | 274.9 | 33.39 | 45.732 | 17.291 | 19.777 | 0.684 |
| 6 iron | 952 | 754.4 | 394.1 | 283.5 | 33.77 | 46.166 | 17.333 | 19.850 | 0.704 |
| 7 iron | 940 | 748.1 | 401.7 | 291.7 | 34.10 | 46.566 | 17.371 | 19.918 | 0.723 |
| 8 iron | 927 | 741.5 | 409.9 | 301.1 | 34.42 | 46.999 | 17.412 | 19.991 | 0.742 |
| 9 iron | 914 | 735.0 | 418.2 | 310.9 | 34.72 | 47.433 | 17.454 | 20.065 | 0.762 |

The target torsional moments are presented without allowed deviation.

The difference in length between each golf club is approximately ½ inch (12.7 mm) and the loft of the head increases through the set as the club length decreases. Conventionally, the club head weight increases with seven grams for each ½ inch reduction in length. However, the head weights in the inventive set of golf club do not have a fixed weight difference for each ½ inch, as is obvious from table 5. The head weight difference between a 3 iron and a 4 iron is 7.3 grams, but the head weight difference between an 8 iron and a 9 iron is 9.8 grams. Furthermore, the CG length is not constant for the golf clubs within the set, and increases as the length of the golf club decreases. The club head weight difference and CG length differences are individually obtained for each golfer and may vary.

If the grip weight and grip balance point is identical for the golf clubs in the set, the following golf club parameters may be obtained:

TABLE 6

Actual parameters for components of 3 iron-9 iron clubs ($\Delta_g$ = 5 mm).

| Club | $L_k$ [mm] | $m_{kh}$ [grams] | $L_{CG}$ [mm] | $L_{BP,s}$ [mm] | $m_s$ [grams] | $m_k$ [grams] | $L_{BP}$ [mm] | swingweight |
|---|---|---|---|---|---|---|---|---|
| 3 iron | 990 | 259.3 | 32.58 | 395.7 | 66.1 | 370.4 | 775.5 | 216.0 D 1.4 |
| 4 iron | 978 | 266.6 | 32.99 | 382.1 | 66.3 | 377.9 | 768.6 | 216.7 D 1.9 |
| 5 iron | 965 | 274.9 | 33.39 | 367.2 | 66.1 | 386.0 | 761.4 | 217.5 D 2.3 |
| 6 iron | 952 | 283.5 | 33.77 | 351.8 | 65.7 | 394.1 | 754.4 | 218.3 D 2.7 |
| 7 iron | 940 | 291.7 | 34.10 | 337.2 | 64.9 | 401.7 | 748.1 | 219.0 D 3.1 |
| 8 iron | 927 | 301.1 | 34.42 | 320.5 | 63.8 | 409.9 | 741.5 | 219.7 D 3.5 |
| 9 iron | 914 | 310.9 | 34.72 | 302.8 | 62.3 | 418.2 | 735.0 | 220.3 D 3.9 |

It should be noted that the although the total weight of the golf club is increasing with shorter club length, the weight of the shaft is rather constant for the longer clubs (3 iron, 4 iron and 5 iron) and is increasingly reduced for the shorter clubs (7 iron, 8 iron and 9 iron). The shaft balance point length is increasingly reduced with shorter clubs, and the swingweight is gradually increased with shorter clubs.

Iron clubs are used to illustrate the inventive concept, but it is naturally possible to design other types of golf clubs, such as metal woods, hybrids, drivers, wedges and putters, using the same methodology.

It should be noted that the first torsional moment (i.e. PCF) is a load that affects the golfer at the centre of rotation 15, in FIG. 1, and the second, third and fourth torsional moments (i.e. ICF, HCF and GCF) are loads that affects the golfer at the wrists 16, in FIG. 1.

Each torsional moment may be separately used to adapt a set of golf clubs to its user. However, it should be noted that each torsional moment is not independent of the other torsional moments as is obvious from the Swedish patent application SE 0702905-1. A change in any torsional moment for a golf club will affect one or more additional torsional moments. Four examples are illustrated below to highlight each torsional moment.

PCF

The Plane control factor (PCF) is a function of the club weight $m_k$, the balance point length $L_{BP}$ and a constant $L_a$ (which is related to the arm length of the golfer), as is obvious from equation (6). A set of golf clubs, in which each golf club has a predetermined length, may be adjusted by altering the balance point length and club weight of a short golf club to determine a suitable PCF for the short club, which is obtained when the golfer stabilizes the swing plane and velocity at impact. The same procedure is repeated for a longer golf club to determine a suitable PCF for the longer golf club. A straight line having a slope is drawn between the two PCF values as a function of club length. The club weight and balance point length may now be adjusted on the rest of the golf clubs within the set.

PCF is preferably combined with the Impact Control Factor (ICF), which is a function of the club weight and the balance point length, as is obvious from equation (3). PCF in combination with ICF will generate an optimum balance point length and club weight for a given PCF and a given ICF, as is obvious from the description in relation to FIG. 5.

ICF

Impact Control Factor is a function of the club weight and the balance point length, as is obvious from equation (17). A set of golf clubs, in which each golf club has a predetermined length, may be adjusted by altering the balance point length and club weight of a short golf club to determine a suitable ICF for the short club, which is obtained when feeling of the golf head and the wrist action through the swing is consistent. The same procedure is repeated for a longer golf club to determine a suitable ICF for the longer golf club. A straight line having a slope is drawn between the two ICF values as a function of club length. The club weight and balance point length may now be adjusted on the rest of the golf clubs within the set.

ICF is preferably combined with Plane Control Factor (PCF), which is a function of club weight $m_k$, balance point length $L_{BP}$ and a constant $L_a$ (which is related to the arm length of the golfer). ICF in combination with PCF will generate an optimum balance point length and club weight for a given PCF and a given ICF, as is obvious from the description in relation to FIG. 5.

HCF

Head Control Factor is a function of the club length $L_k$ and the club head weight $m_{kh}$, as is obvious from equation (10). A set of golf clubs, in which each golf club has a predetermined length, may be adjusted by altering the club head weight of a short golf club to determine a suitable HCF for the short club, which is obtained when the impact on the ball is consistent in the club head. The same procedure is repeated for a longer golf club to determine a suitable HCF for the longer golf club. A straight line having a slope is drawn between the two HCF values as a function of club length. The club head weight may now be adjusted on the rest of the golf clubs within the set.

HCF is preferably combined with Gear Control Factor (GCF), which is a function of club length $L_k$, CG length $L_{CG}$ and club head weight $m_{kh}$, as is obvious from equation (12). HCF in combination with GCF will generate an optimum CG length for a given HCF and a given GCF, as described in the Swedish patent application SE0702905-1.

GCF

Gear Control Factor (GCF) is particularly suitable for improving a traditionally designed set of golf clubs. GCF is a function of club length $L_k$, CG length $L_{CG}$ and club head weight $m_{kh}$, as is obvious from equation (12). A set of golf clubs, in which each golf club has a predetermined length, may be adjusted by altering the CG length of a short golf club to determine a suitable GCF for the short club, which is obtained when the feeling of the golf head is consistent, the golfer is able to work the ball (control draw/fade) consistently and the golfer is able to control the angle of the head in relation to the swing plane consistently. The same procedure is repeated for a longer golf club to determine a suitable GCF for the longer golf club. A straight line having a slope is drawn between the two GCF values as a function of club length. The CG length may now be adjusted on the rest of the golf clubs within the set.

GCF is preferably combined with Head Control Factor (HCF), which is a function of club length $L_k$, and club head weight $m_{kh}$, as is obvious from equation (10). GCF in combination with HCF will generate an optimum CG length for a given GCF and a given HCF, as described in the Swedish patent application SE0702905-1).

It is more preferred to combine all four torsional moments when designing a set of golf clubs, as illustrated above in connection with the description of tables 1-6. However, each of the described torsional moments will improve a conventional set of golf clubs.

The important characteristics of the invention is not to obtain lower/higher torsional moments than prior art, but to give the golfer the proper loads to enable to repeat the same swing motion over and over again (get the proper feedback), and thus maximizing the golfer's potential in golf.

The invention claimed is:

1. A method of determining club parameters for at least one golf club, belonging to a set of golf clubs for a specific golfer, having arbitrary club length $L_{k,n}$, each golf club having a shaft with an upper end and a lower end, a grip section on the upper end of the shaft, a head with a ball-striking surface mounted on the lower end of the shaft, a balance point BP wherein a balance point length $L_{BP,n}$ is defined from the distal end of the grip section to the balance point BP, a club weight $m_{k,n}$, and a club head weight $m_{kh,n}$ with a centre of gravity CG arranged in a CG plane perpendicular to a first direction along the centre of the shaft, the club length $L_{k,n}$ is defined as a first distance from the distal end of the grip section to the CG plane along the first direction, the method comprising:

A) selecting club length $L_{ref,I}$ of a first reference golf club,

B) varying at least one club parameter belonging to the group consisting of: club weight, club head weight, CG length and balance point length of the first reference golf club to identify an interval for each varied club parameter of the first reference golf club for the golfer, B1) the golfer hits a ball repeatedly, C) selecting a club parameter within each identified interval, whereby the golfer is able to repeatedly hit a ball with a limited spread in at least one parameter belonging to the group consisting of: launch angle, spin, carry distance, swing tempo, spread angle, ball impact position on ball striking surface, ball speed at impact, and club speed at impact, D) selecting club length $L_{ref,II}$ of a second reference golf club being different than the club length $L_{ref,I}$ of the first reference golf club, E) repeating B, B1 and C for the second reference golf club, and F) calculating at least one torsional moment (PCF, ICF, HCF, GCF) based on the selected at least one club parameter for the first reference golf club and the second reference golf club, G) determining a relationship of each torsional moment (PCF, ICF, HCF, GCF) as a function of club length based on each corresponding calculated torsional moment in F, and H) selecting club length $L_{k,1}$ for a first golf club belonging to the set of golf clubs and determining club parameters for the first golf club based on each determined relationship in G.

2. The method according to claim 1, wherein the club length $L_{ref,I}$ of the first reference golf club in A is selected to be shorter than the club length $L_{ref,II}$ of the second reference club in D.

3. The method according to claim 2, wherein the difference in club length $L_{ref,II-I}$ between the first reference golf club and the second reference golf club is selected to be at least 76.2 mm.

4. The method according to claim 1, wherein the step of determining a relationship of each torsional moment in G comprises providing a linear function that passes through corresponding calculated torsional moments for the first reference golf club and the second reference golf club.

5. The method according to claim 1, wherein the varied club parameters in B include club weight $m_k$ and balance point length of the first reference golf club to identify a club weight interval and a balance point length interval, wherein the step of calculating at least one torsional moment in F involves F1) calculating a first torsional moment (PCF) being a function of club weight $m_k$, balance point length $L_{BP}$, and arm length $L_a$ of the golfer for the first reference golf club and the second reference golf club, and F2) calculating a second torsional moment (ICF) being a function of club weight $m_k$, and balance point length $L_{BP}$ for the first reference golf club and the second reference golf club, wherein the step of determining a relationship for each torsional moment in G involves G1) determining a first relationship of the first torsional moment (PCF) as a function of club length based on the calculated first torsional moments in F1, and G2) determining a second relationship of the second torsional moment (ICF) as a function of club length based on the calculated second torsional moments in F2, and wherein the club parameters determined in H for the first golf club include club weight $m_{k,1}$ and balance point length $L_{BP,1}$ based on the determined first and second relationships in G1 and G2.

6. The method according to claim 5, wherein the first torsional moment (PCF) and the second torsional moment (ICF) calculated in F1 and F2, respectively, are selected to be:

$$PCF=(L_a+L_{BP})\cdot a_{BP}\cdot m_k,$$

$$ICF=L_{BP}\cdot(a_{BP}-a_h)\cdot m_k$$

$L_a$ is arm length of the golfer; $L_{BP}$ is balance point length; $a_{BP}$ is acceleration in the balance point and $a_h$ is acceleration in the wrists of the golfer when the golf club hits a golf ball; and $m_k$ is the club weight.

7. The method according to claim 5, wherein the arm length $L_a$ is selected to be a non-changing constant.

8. The method according to claim 5, wherein the varied club parameters in B include club head weight $m_{kh}$ of the first reference golf club to identify a club head weight interval, wherein the step of calculating at least one torsional moment in F further involves F3) calculating a third torsional moment (HCF) being a function of club head weight $m_{kh}$, and club length $L_k$ of the first reference golf club and the second reference golf club, wherein the step of determining a relationship for each torsional moment in G further involves G3) determining a third relationship of the third torsional moment (HCF) as a function of club length based on the calculated third torsional moments in F3, and wherein the club parameters determined in H for the first golf club include club head weight $m_{kh,1}$ based on the determined third relationships in G3.

9. The method according to claim 8, wherein the third torsional moment (HCF) calculated in F3 is selected to be:

$$HCF=L_k\cdot(a_{CG}-a_h)\cdot m_{kh},$$

$L_k$ is club length; $a_{CG}$ is acceleration in CG and $a_h$ is acceleration in the wrists of the golfer when the golf club hits a golf ball; and $m_{kh}$ is the club head weight.

10. The method according to claim 8, wherein the varied club parameters in B include CG length $L_{CG}$ of the first reference golf club to identify a CG length interval, the CG length is arranged in the CG plane and represents a distance from a zero point in the CG plane, the zero point is in the prolongation of the centre of the shaft along the first direction, to one of:

the centre of gravity CG, or a point on a line through a sweet spot on the ball-striking surface and the centre of gravity CG, wherein the step of calculating at least one torsional moment in F further involves F4) calculating a fourth torsional moment (GCF) being a function of club head weight $m_{kh}$ and CG length $L_{CG}$ of the first reference golf club and the second reference golf club, wherein the step of determining a relationship for each torsional moment in G further involves G4) determining a fourth relationship of the fourth torsional moment (GCF) as a function of club length based on the calculated fourth torsional moments in F4, and wherein the club parameters determined in H for the first golf club include club head weight $m_{kh,1}$ and CG length $L_{CG,1}$ based on the determined fourth relationships in G4.

11. The method according to claim 10, wherein the fourth torsional moment (GCF) calculated in F4 is selected to be:

$$GCF=L_{CG}\cdot(a_{CG}-a_h)\cdot m_{kh},$$

$L_{CG}$ is CG length; $a_{CG}$ is acceleration in CG and $a_h$ is acceleration in the wrists of the golfer when the golf club hits a golf ball; and $m_{kh}$ is the club head weight.

12. The method according to claim 1, wherein H is repeated for at least one additional golf club each having a selected club length $L_{k,n}$ to determine club parameters for the additional golf club based on each determined relationship in G.

13. The method according to claim 12, wherein each additional golf club has a mutually different club length $L_{k,n}$ and differs from the club length $L_{k,1}$ of the first golf club ($L_{k,n}\neq L_{k,1}$).

14. The method according to claim 1, wherein the first golf club or at least one of the additional golf clubs is selected to be a putter.

15. The method according to claim 1, wherein the first golf club and the additional golf clubs include at least a driver, fairway woods, hybrids, iron clubs, wedges and a putter.

* * * * *